US006312283B1

(12) United States Patent
Hio

(10) Patent No.: US 6,312,283 B1
(45) Date of Patent: Nov. 6, 2001

(54) METHOD OF CONNECTING TERMINAL FITTING TO FLAT CONDUCTOR AND TERMINAL FITTING FOR FLAT CONDUCTOR

(75) Inventor: Masahide Hio, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/703,965

(22) Filed: Nov. 1, 2000

(30) Foreign Application Priority Data

Nov. 1, 1999 (JP) ..... 11-311255

(51) Int. Cl.[7] ..... H01R 4/24
(52) U.S. Cl. ..... 439/422
(58) Field of Search ..... 439/422, 421, 439/423, 424, 877

(56) References Cited

U.S. PATENT DOCUMENTS

| | | | | |
|---|---|---|---|---|
| 3,997,233 | * | 12/1976 | Evans | 439/422 |
| 4,040,702 | | 8/1977 | McKee et al. . | |
| 4,082,402 | | 4/1978 | Kinkaid et al. . | |
| 4,560,224 | * | 12/1985 | Weisenburger | 439/422 |
| 4,832,620 | * | 5/1989 | Yamamoto | 439/422 |
| 6,135,779 | * | 10/2000 | Kock et al. | 439/422 |

FOREIGN PATENT DOCUMENTS

| | | |
|---|---|---|
| 63-73861 | 5/1988 | (JP) . |
| 63-73862 | 5/1988 | (JP) . |

* cited by examiner

*Primary Examiner*—Tho D. Ta
(74) *Attorney, Agent, or Firm*—Anthony J. Casella; Gerald E. Hespos

(57) ABSTRACT

A terminal fitting (20) is provided for an FFC (10). The FFC (10) includes a conductive path (11) that has upper and lower surfaces covered with an insulation sheet (12). The terminal fitting (20) includes bottom plate (22) with contact blades (25) erected on both side edges of the bottom plate (22). A ceiling plate (23) confronts the bottom plate (22) and can penetrate into the space between the opposed contact blades (25). When the ceiling plate (23) is closed, it moves downward, with both side surfaces thereof in sliding contact with an inner surface of each contact blade (25), while the ceiling plate (23) presses the terminal of the FFC (10) toward the bottom plate (22). Consequently, the contact blades (25) pierce through the terminal of the FFC (10). The contact blades (25) pierce into the conductive path (11) and the ceiling plate (23) prevents floating of the FFC (10). Thus, it is possible to allow a cut surface (11A) of the conductive path (11) located inward from the contact blades (25) to properly confront the inner surfaces of the contact blades (25).

13 Claims, 8 Drawing Sheets

METHOD OF CONNECTING TERMINAL FITTING TO FLAT CONDUCTOR AND TERMINAL FITTING FOR FLAT CONDUCTOR

BACKGROUND OF THE INVENTION

1. Field of the Invention

The present invention relates to a method of connecting a terminal fitting to a flat conductor and a terminal fitting for the flat conductor.

2. Description of the Related Art

Prior art flat conductors include an FFC (flexible flat cable) and an FPC (flexible print circuit board). The prior art FFC includes a plurality of conductive paths arranged in parallel with one another and sandwiched between insulation sheets. The FFC is flexible and formed in the shape of a ribbon.

Terminal fittings are connected to the conductive paths of the FFC by embedding portions of the terminal fitting in the insulation sheet or by tearing off a section of the insulation sheet of the FFC to expose sections the conductive paths on one surface of the FFC.

The former method of connecting a terminal fitting to an FFC is called a through type method, and has an advantage of omitting the stage of tearing off the insulation sheet. This method is disclosed in Japanese Patent Application Laid-Open No. 50-100585, which is shown in FIG. 12A. The method of FIG. 12A includes providing a terminal fitting 1 with contact blades 2 erected on both side edges of the terminal fitting 1. Both contact blades 2 pierce a conductive path 4 of an FFC 3 to bring cut end surfaces of the conductive path 4 into contact with side surfaces of the contact blade 2.

However, in the above-described method, when the contact blade 2 pierces through the conductive path 4, as shown in FIG. 12B, the FFC 3 is liable to curve between the opposed contact blades 2. Therefore, there is a possibility that a cut surface 4A of the conductive path 4 does not confront the side surfaces of the contact blade 2 properly or only a part (corner) of an insulation sheet 5 is in contact with the side surfaces of the contact blade 2. Thus, the method is not reliable in electrical contact.

The present invention has been completed in view of the above-described situation. Thus, it is an object of the present invention to allow a reliable contact between a contact blade of a terminal fitting of through type and a cut surface of a conductive path of a flat conductor.

SUMMARY OF THE INVENTION

The subject invention is directed to a method of connecting a terminal fitting to a flat conductor. The flat conductor includes at least one conductive path embedded in an insulation layer. A terminal fitting is provided with a base plate and at least one contact blade projecting from the base plate. The contact blade is pierced into the conductive path, such that a surface of the flat conductor is in contact with the base plate. A pressing plate then presses the flat conductor toward the base plate.

The pressing plate remains on the flat conductor, with the flat conductor being sandwiched between the base plate and the pressing plate.

The invention also is directed to a terminal fitting connected to a flat conductor whose conductive path is embedded in an insulation layer. The terminal fitting includes a base plate from which at least one contact blade is erected. The contact blade is pierced through the conductive path, such that a surface of the flat conductor is in contact with a base plate. The terminal fitting further comprises a pressing plate for pressing the conductive plate toward the base plate, and thus causing the contact blade to pierce into the conductive path. The pressing plate remains on the flat conductor, such that the flat conductor is sandwiched between the base plate and the pressing plate after the contact blade is pierced into the conductive path. The pressing plate further includes an insertion hole through which a projected end of the contact blade is inserted. The insertion hole fits on the contact blade tightly in a thickness direction thereof and has a clearance in a widthwise direction thereof.

The contact blades pierce into the conductive path, and the ceiling plate prevents float of the conductive path. Thus, the cut surface of the conductive path confronts the inner and outer surface of the contact blades to obtain a good contact state.

The ceiling plate is left on the flat conductor after the ceiling plate presses the flat conductor against the bottom plate. Thus, it is possible to keep the cut surface of the conductive path in confrontation with the contact blades properly.

The front end of the contact blade is pierced into the flat conductor and is inserted into the insertion hole of the pressing plate. The insertion hole is dimensioned to provide a clearance. Chips generated when the contact blade pierces into the flat conductor are introduced into the clearance formed for the contact blade at the outer side of the widthwise direction thereof. That is, it is possible to prevent the chips from being introduced into the space between the cut surface of the conductive path and the inner and outer surfaces of the contact blade. This construction allows a preferable contact between the cut surface of the conductive path and the contact blade.

DETAILED DESCRIPTION OF THE PREFERRED EMBODIMENTS

The first embodiment of the present invention will be described below with reference to FIGS. 1 through 8.

Figure 1:
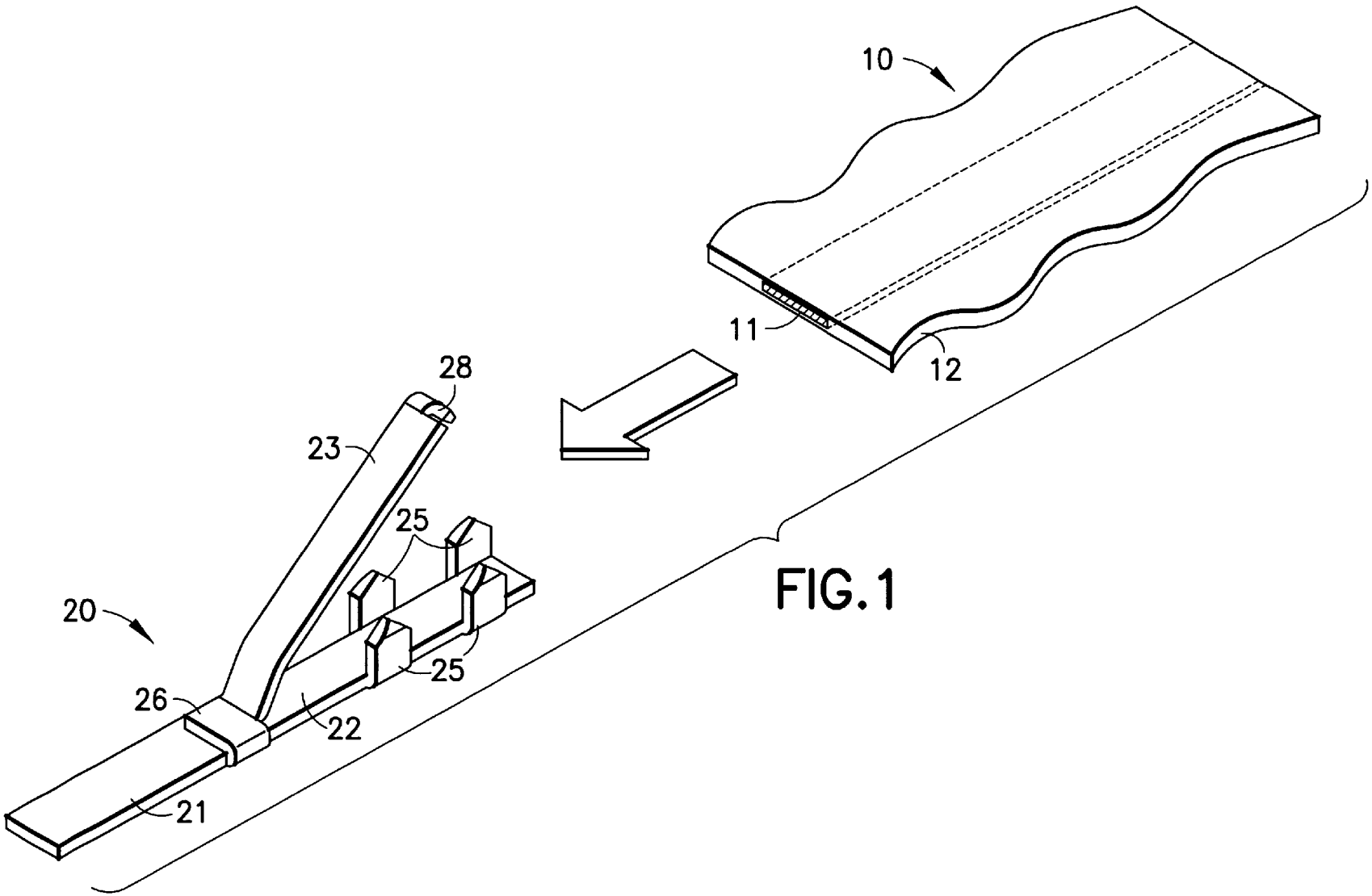
FIG. 1 is a perspective view showing a terminal fitting of a first embodiment of the present invention and an FFC not connected thereto.

A flexible ribbon-shaped FFC (flexible flat cable) is identified generally by the numeral 10 in FIG. 1. The FFC 10 has a plurality of conductive paths 11 arranged in parallel with one another at predetermined intervals. The conductive paths 11 are embedded in insulation sheets 12 disposed on upper and lower surfaces of the conductive paths 11.

Figure 2:
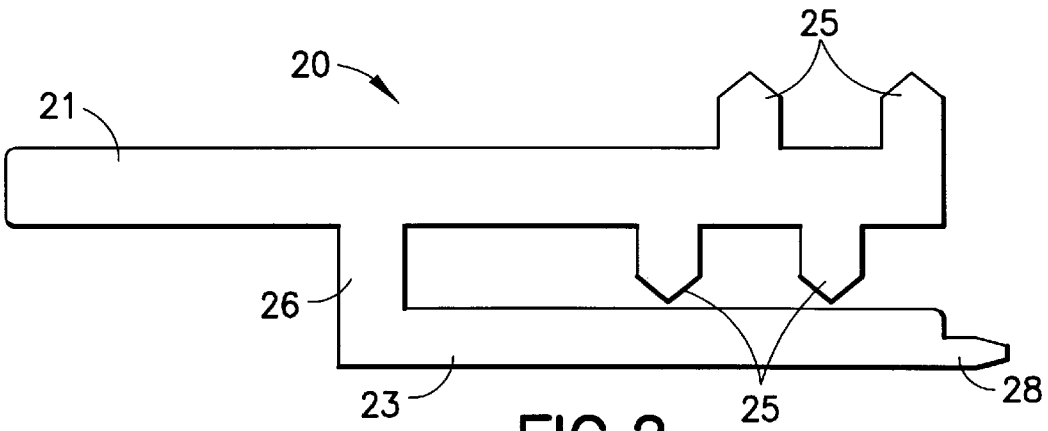
FIG. 2 is a top plan view of a metal blank for forming the terminal fitting of FIG. 1.
Figure 3:
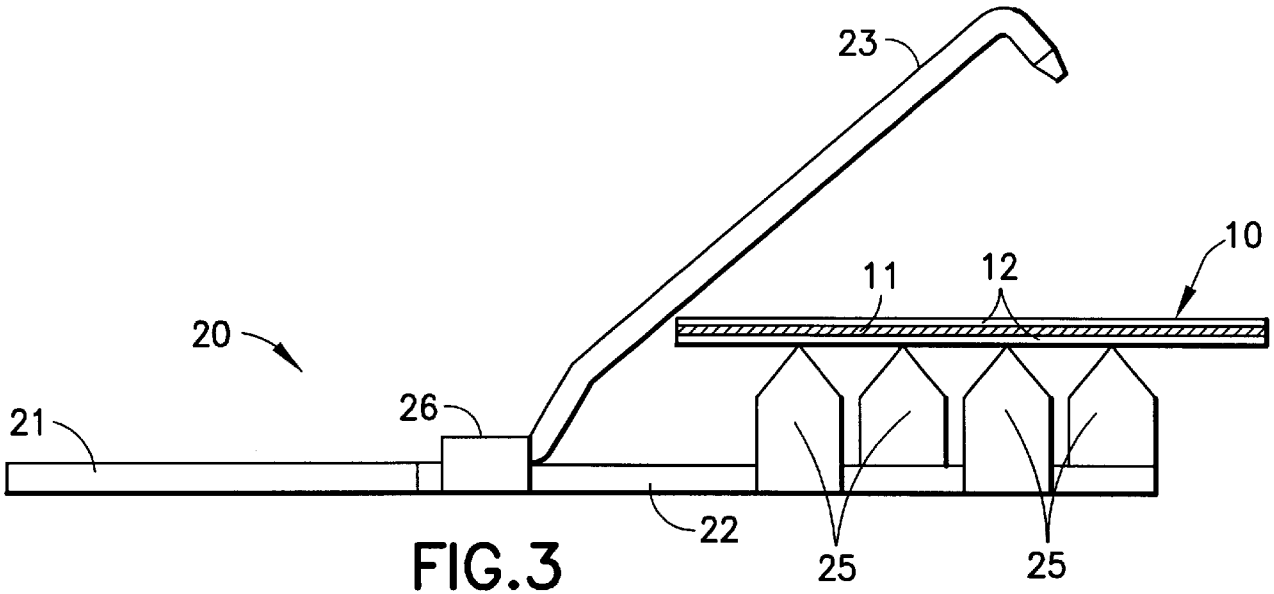
FIG. 3 is a partly cutout side view showing the terminal fitting and the FFC not connected thereto.

A terminal fitting 20 of the first embodiment is formed as a male terminal fitting by press-molding a highly electrically conductive metal plate. As shown in FIGS. 1–3, the terminal fitting 20 includes a tab 21 with a front end to be fitted on a mating terminal and an opposed rear end. A bottom plate 22 is extended rearward from the rear end of a tab 21, and a ceiling plate 23 confronts the bottom plate 22 vertically.

The bottom plate 22 is slightly narrower than the conductive path 11 and has opposite left and right side edges. Two contact blades 25 are formed at the left side edge of the bottom plate 22, and two contact blades 25 are formed at the right side edge thereof. The contact blades 25 are erected on the bottom plate 22 such that they alternate with one another along the length of the bottom plate 22. The upper end of each contact blade 25 is tapered to a point.

The ceiling plate 23 has a width equal to the width of the space between the contact blades 25 on the left side edge of the base plate 22 and the contact blades 25 on the right side edge. The metal blank for forming the terminal fitting 20 has the ceiling plate 23 formed parallel with the bottom plate 22 and connected to the base plate 22 by a bending part 26 that projects sideways from a location substantially where the tab 21 and the base plate 22 meet. The bending part 26 then is bent to be in close contact with the tab 21. Thus, as described above, the ceiling plate 23 confronts the bottom plate 22 and is integral with the tab 21 and the base plate 22. As a result, the rear end of the ceiling plate 23 can be opened and closed relative to the base plate 22.

A piercing piece 28 that can be inserted into the FFC 10 is formed at the rear end of the ceiling plate 23, and defines a width of about the half of the entire width of the ceiling plate 23. The lower end of the piercing piece 28 is tapered off to a point that is directed downward toward the bottom plate 22 and substantially perpendicular to the ceiling plate 23.

Figure 4:
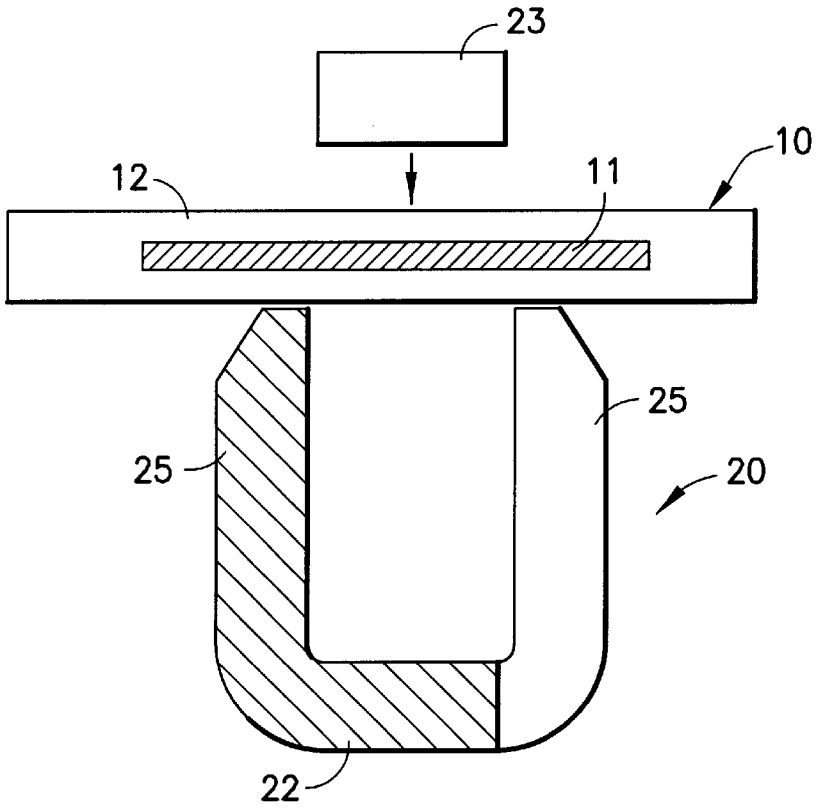
FIG. 4 is an enlarged cross-section view showing a state before a contact blade is pierced into a flat conductor.
Figure 5:
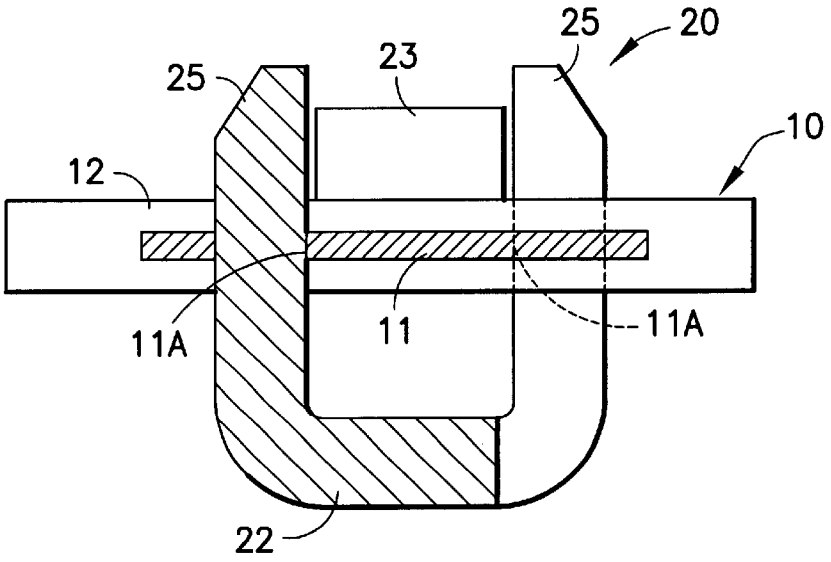
FIG. 5 is an enlarged cross-section view showing a state in which the contact blade is being pierced into the flat conductor.

The terminal fitting 20 is connected to the FFC 10 by initially opening the ceiling plate 23 of the terminal fitting 20 upward, as shown in FIG. 1. Next, as shown in FIGS. 3 and 4, the terminal of the FFC 10 is placed on the contact blades 25 formed on side edges of the bottom plate 22 by adjusting the mating position of the conductive path 11 to the location of the terminal fitting 20. Then, as shown by the arrow of FIG. 4, the ceiling plate 23 is pivoted into a closed position. As a result, as shown in FIG. 5, the side edges of the ceiling plate 23 move downward in sliding contact with the inner surface of each contact blade 25, such that the ceiling plate 23 presses the FFC 10 toward the bottom plate 22. Consequently, the contact blades 25 at the left and right side edges of the bottom plate 22 pierce into the lower surface of the FFC 10 at positions located slightly inward from the left and right side edges of the conductive path 11 and project from the upper surface of terminal of the FFC 10.

Figure 6:
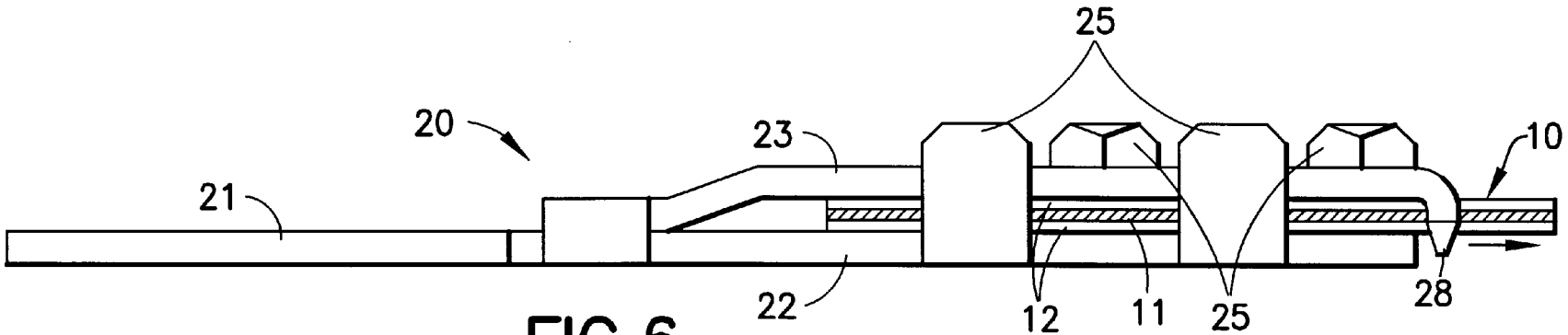
FIG. 6 is a partly cutout side view showing the terminal fitting and the FFC connected thereto.
Figure 7:
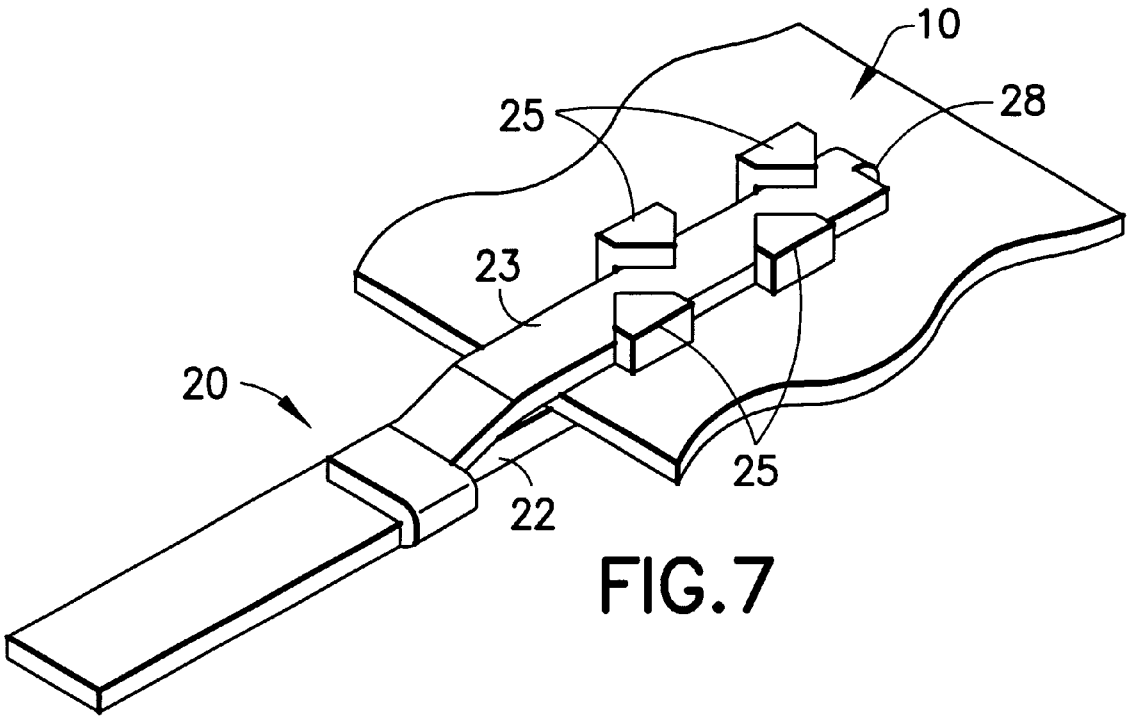
FIG. 7 is a perspective view showing the terminal fitting and the FFC connected thereto.
Figure 8:
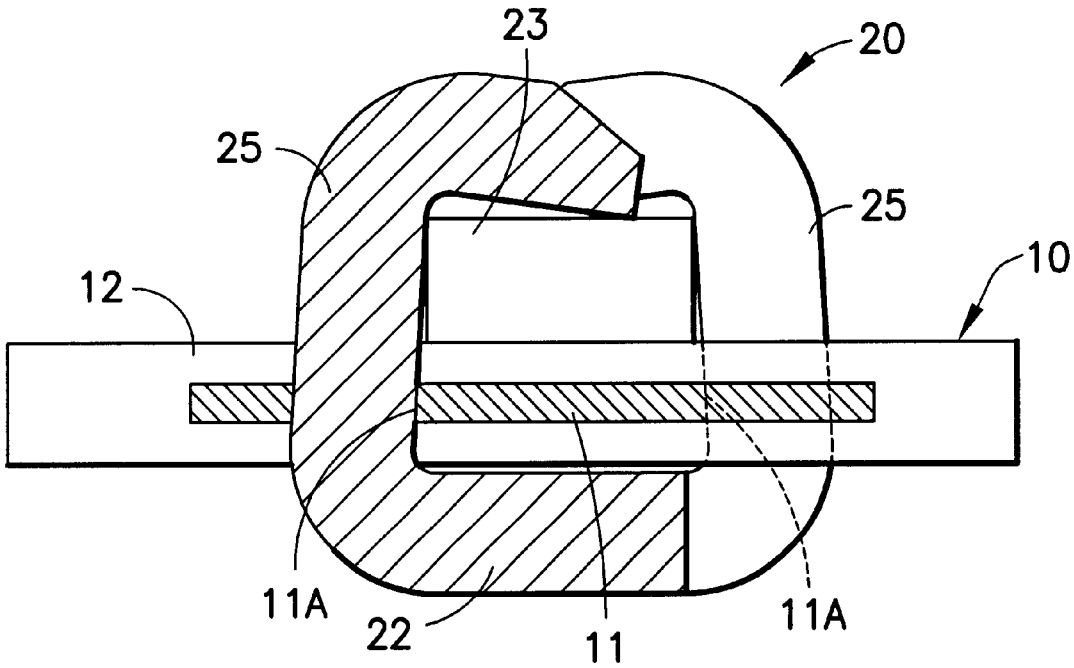
FIG. 8 is an enlarged cross-sectional view of FIG. 7.

When the terminal of the FFC 10 contacts the bottom plate 22 by the pressing operation of the ceiling plate 23, the projected end (upper end) of each contact blade 25 is bent inward and crimped to both side edges of the ceiling plate 23. Consequently, as shown in FIGS. 6 through 8, the terminal fitting 20 is connected to the FFC 10, with the ceiling plate 23 and the bottom plate 22 placed in the closed state.

The piercing piece 28 formed at the rear end of the ceiling plate 23 pierces the conductive path 11 of the FFC 10 and projects from the lower surface of the FFC 10.

As described above, the contact blades 25 pierce the conductive path 11, and the ceiling plate 23 is interposed between the contact blades 25 at both side edges of the bottom plate 22. As a result, the ceiling plate 23 prevents the FFC 10 from floating, and it is possible to allow a cut surface 11A of the conductive path 11 located inward from the contact blades 25 to properly confront the inner surfaces of the contact blades 25. Thus, it is possible to obtain a preferable contact state and thereby it is possible to obtain a stable electrical performance.

The ceiling plate 23 is left on the FFC 10 after the ceiling plate 23 is used to press the FFC 10 against the bottom plate 22. Thus, it is possible to keep the cut surface 11A of the conductive path 11 in confrontation with the contact blades 25 properly.

The FFC 10 is used with the terminal fitting 20 connected with the terminal of the FFC 10 and accommodated in a cavity of a connector housing (not shown). A tensile force may be applied to the FFC 10 in a rearward direction (to the right in FIG. 6). However, the piercing piece 28 formed at the rear end of the ceiling plate 23 pierces the FFC 10 in a direction perpendicular to the direction of the applied tensile force, thus hooking the terminal fitting 20 firmly in resistance to the tensile force. Therefore, the terminal fitting 20 is not easily removed from the terminal of the FFC 10.

Further, because the piercing piece 28 pierces the conductive path 11, it is possible to increase the contact area between the terminal fitting 20 and the conductive path 11.

Figure 9:
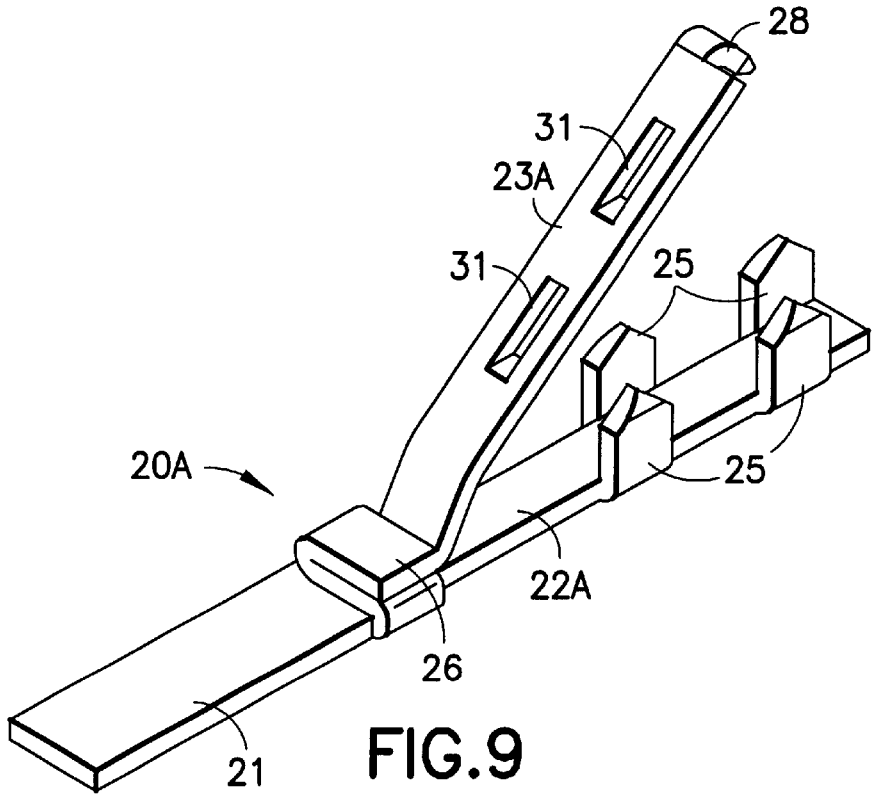
FIG. 9 is a perspective view showing a terminal fitting of a second embodiment of the present invention not connected to the FFC.

The second embodiment of the present invention is directed to a terminal fitting 20A, as shown in FIGS. 7 through 9. The terminal fitting 20A of the second embodiment has a bottom plate 22A that is narrower than the bottom plate 22 of the first embodiment and is formed with a leftward offset when viewed from the front. The bottom plate 22A includes left and right side edges. Two contact blades 25 are formed on the left side edge of the narrow bottom plate 22A and two contact blades are formed on the right side edge, such that the contact blades 25 on the left and right side edges alternate with one another.

The terminal fitting 20A further includes a ceiling plate 23A, and two slit-shaped insertion holes 31 are formed on the ceiling plate 23A. The contact blades 25 at the right side in a front view can be inserted through the insertion holes 31. Each insertion hole 31 is formed to contact the respective contact blade 25 closely in the thickness direction, but each insertion hole 31 has a clearance for the contact blade 25 in the widthwise direction.

The other constructions are similar to those of the first embodiment. Thus, parts of the second embodiment that have the same functions as parts of the first embodiment are denoted by the same reference numerals and symbols. Therefore, the descriptions of those parts are omitted herein.

In the second embodiment, the FFC 10 is placed on the contact blades 25, and the ceiling plate 23A is pivoted downward to a closed position. As a result, the ceiling plate 23A presses the FFC 10 toward the bottom plate 22A, and the contact blades 25 formed at the left and right side edges of the bottom plate 22A are pierced into the lower surface of the FFC 10. More specifically, the left-side contact blades 25 in a front view pierce into positions slightly inward from the left side edge of the conductive path 11 and project from the upper surface of the FFC 10, whereas the right-side contact blades 25 pierce into positions slightly inward from the right side edge of the conductive path 11 and project from the upper surface of the FFC 10 through the insertion hole 31 of the ceiling plate 23A.

Figure 10:
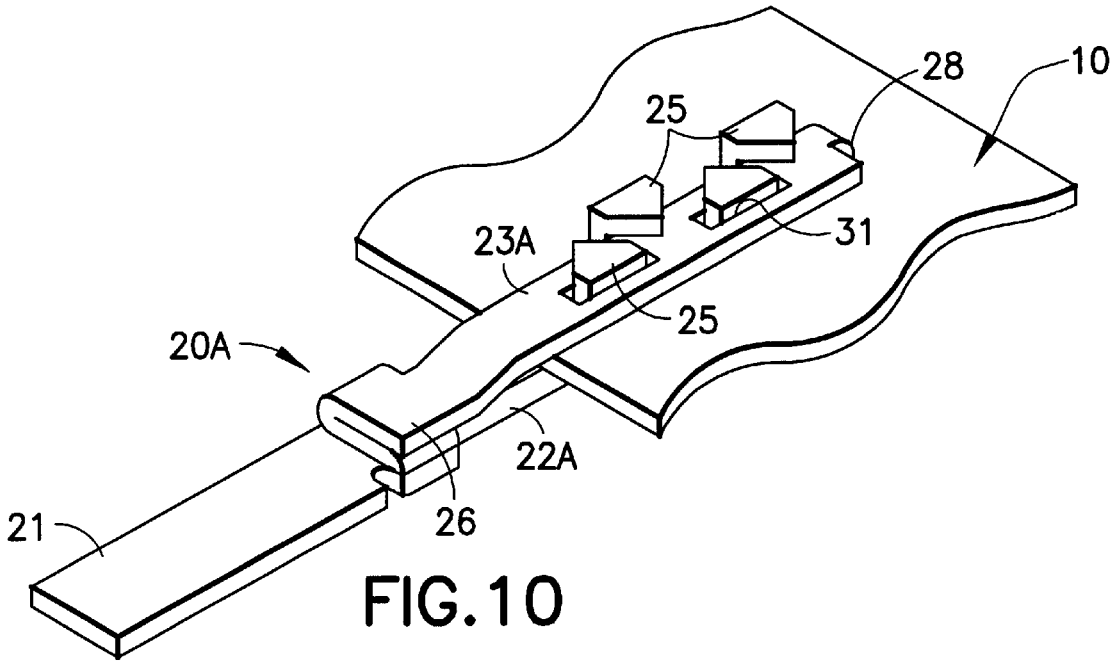
FIG. 10 is a perspective view showing the terminal fitting of FIG. 9 connected to the FFC.

When the FFC 10 contacts the bottom plate 22A by the pressing operation of the ceiling plate 23A, the projected end (upper end) of each contact blade 25 is bent inward and crimped to the upper surface of the ceiling plate 23A. Consequently, as shown in FIG. 10, the bottom plate 22A and the ceiling plate 23A are connected to each other in a closed state.

As described above, the contact blades 25 of the second embodiment are pierced into the conductive path 11, and the ceiling plate 23A prevents floating of the FFC 10. Therefore, it is possible to allow the cut surface 11A of the conductive path 11 to confront the inner and outer surface of the contact blades 25 properly, and it is possible to obtain a preferable contact state.

Figure 11A:
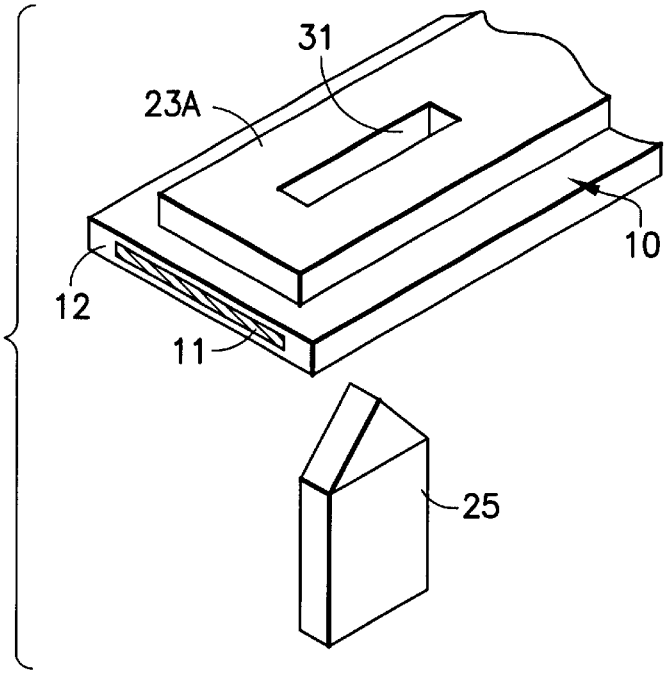
FIGS. 11(A), 11(B) and 11(C) are perspective views, partly in section, showing a piercing mode of a contact blade pierced into an insertion hole formed on a ceiling plate.
Figure 11B:
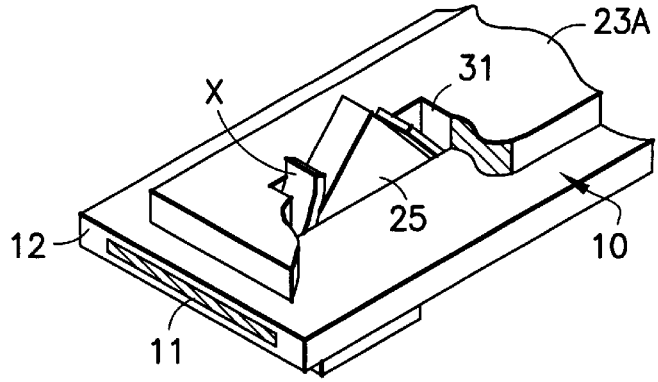
Figure 11C:
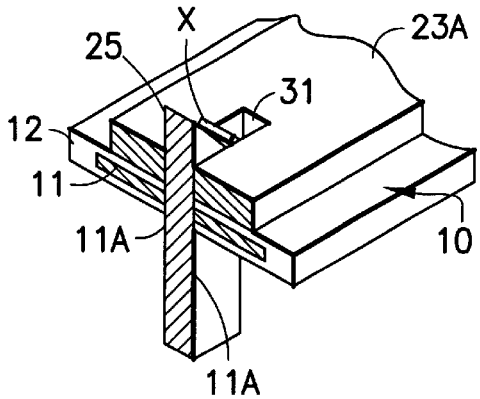
Figure 12A:
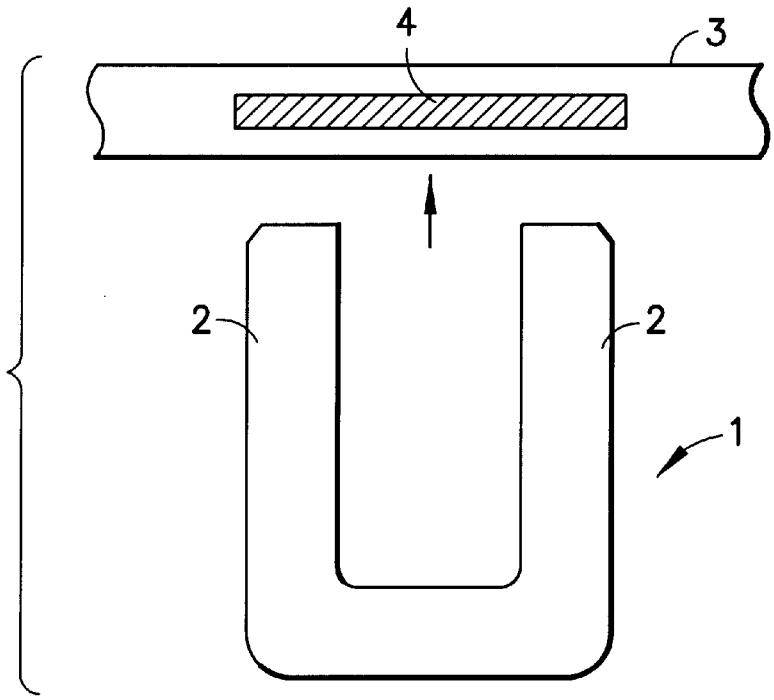
FIG. 12A PRIOR ART
FIGS. 12(A) and 12(B) are cross-sectional views showing a conventional connection mode.
Figure 12B:
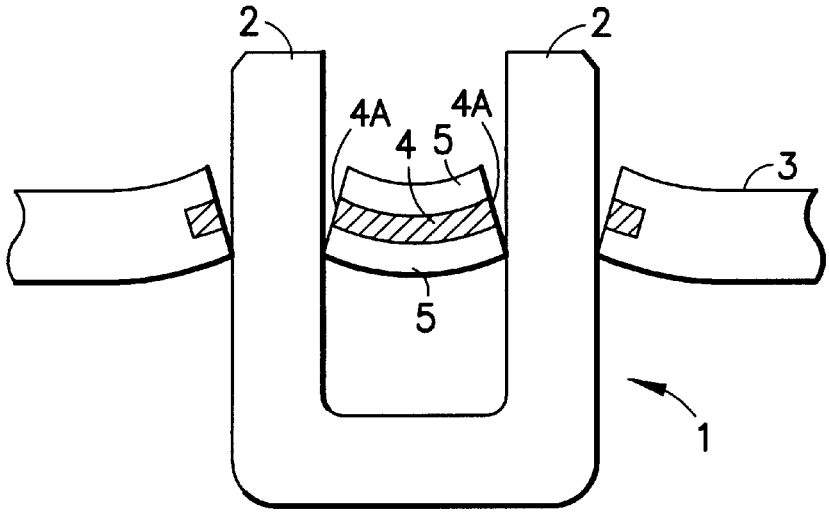
FIG. 12B PRIOR ART

The contact blade 25 is inserted into the insertion hole 31 of the ceiling plate 23A, as shown in FIG. 11A, and the FFC 10 is pressed at the inner and outer sides of the contact blade 25 as shown in FIG. 11B. Thus, it is possible to allow the cut surface 11A of the conductive path 11 to confront the inner and outer surfaces of the contact blade 25 properly.

There is a possibility that when the contact blade is pierced into the FFC 10, the insulation sheet and the like are torn and chips X thereof remain. However, there is a clearance formed in the insertion hole 31 for the contact blade 23 at the outer side of the widthwise direction thereof. Thus, as shown in FIG. 11B, the chips X are introduced into the clearance. That is, it is possible to prevent the chips X from being introduced into the space between the cut surface 11A of the conductive path 11 and the inner and outer surfaces of the contact blade 25. This construction contributes to a preferable contact between the cut surface 11A of the conductive path 11 and the contact blade 25.

The present invention is not limited to the embodiment described above with reference to the drawings. For example, the following embodiments are included in the technical scope of the present invention. Further, various modifications can be made without departing from the spirit and scope of the present invention.

The ceiling plate may be separate from the bottom plate and may be removed from the FFC after the ceiling plate is used to press the FFC against the bottom plate, with the contact blade pierced into the FFC.

It is possible to penetrate the contact blade at one side edge of the bottom plate into the conductive path and crimp the contact blade at the other side thereof to the ceiling plate.

It is possible to form the contact blade on the ceiling plate and function the bottom plate as the pressing plate.

The present invention can be used to connect the female terminal fitting to the FFC.

It is possible to apply the present invention to not only the FFC exemplified in the first embodiment, but also terminal fittings to be used in connection with the flat conductor such as an FPC in which the conductive path is covered with the insulation layer.

What is claimed is:

1. A terminal fitting connected to a flat conductor, the flat conductor having a conductive path embedded in an insulation layer, the terminal fitting comprising:

a base plate;

a contact blade erected from the base plate and pierced through said conductive path, such that a surface of said flat conductor is in contact with the base plate on which said contact blade is erected, said contact blade having oppositely facing surface areas spaced apart by a distance that defines a thickness for the contact blade and oppositely facing edges spaced apart by a distance that defines a width for the contact blade, the thickness being less than the width;

a pressing plate pressing said flat conductor toward said base plate with said flat conductor being sandwiched between said base plate and said pressing plate, said pressing plate comprising an insertion hole through which a projected end of said contact blade is inserted, said insertion hole fitting on said contact blade tightly in a thickness direction of the contact blade and fitting with a clearance adjacent the edges of the contact blade and in a widthwise direction thereof, whereby the insulation layer of the flat conductor is displaced into the clearance and not into regions between the insertion hole of the pressing plate and the oppositely facing surface areas of the contact blade.

2. The terminal fitting of claim 1, wherein the contact blade is deformed over the pressing plate for tightly sandwiching the flat conductor between the base plate and the pressing plate.

3. The terminal fitting of claim 1, wherein the base plate has opposite first and second longitudinal sides, the at least one contact blade comprising at least a first contact blade extending from the first side of the base plate and at least a second contact plate extending from the second side of the base plate, the pressing plate having opposite first and second longitudinal sides, the first contact blade being disposed to be adjacent the first longitudinal side of the pressing plate, the insertion hole being aligned with the second longitudinal side of the base plate and being disposed along the pressing plate to receive the second contact blade, the first and second contact blades being bent over the pressing plate for tightly holding the flat conductor between the base plate and the pressing plate.

4. The terminal fitting of claim 1, further comprising a piercing piece at an end of the pressing plate and aligned to pierce through a portion of the flat conductor axially beyond the base plate.

5. The terminal fitting of claim 1, wherein the base plate and the pressing plate are substantially planar.

6. A terminal fitting for a flat conductor, comprising:

an elongate base plate defining a direction of elongation;

at least one contact blade extending unitarily from the base plate, said contact blade defining a width extending substantially parallel to the direction of elongation and a thickness extending substantially transverse to the direction of elongation; and a pressing plate having a first end pivoted to said base plate for pivoting movement about an axis extending substantially transverse to the direction of elongation, the pressing plate further having a second end selectively movable toward and away from the base plate in response to the pivoting movement of the pressing plate, the pressing plate being formed with an elongate insertion hole dimensioned and disposed to receive the contact blade as the second end of the pressing plate is pivoted toward the base plate, the insertion hole defining a width approximately equal to the thickness of the contact blade and a length greater than the width of the contact blade, wherein portions of the flat conductor displaced by the contact blade enter a clearance defined along the length of the insertion hole and not into areas between the insertion hole of the pressing plate and areas defining the width of the contact blade.

7. The terminal fitting of claim 6, wherein the flat conductor defines a specified thickness, the length of the insertion hole (31) being approximately equal to the width of the contact blade (25) plus twice the specified thickness of the flat conductor.

8. The terminal fitting of claim 6, wherein the contact blade (25) includes a point facing away from the base plate (22), the point being substantially centrally disposed along the width of the contact blade (25).

9. The terminal fitting of claim 4, wherein the base plate (22) is substantially planar, and wherein the contact blade (25) is substantially perpendicular to the base plate (22).

10. The terminal fitting of claim 6, wherein the contact blade is deformed over the pressing plate for tightly sandwiching the flat conductor between elongate base plate and the pressing plate.

11. The terminal fitting of claim 6, further comprising a piercing piece at the second end of the pressing plate and aligned to pierce through a portion of the flat conductor axially beyond the elongate base plate.

12. The terminal fitting of claim 6, wherein the elongate base plate has opposite first and second longitudinal sides, the at least one contact blade comprising at least a first contact blade extending from the first side of the base plate and at least a second contact plate extending from the second side of the base plate, the pressing plate having opposite first and second longitudinal sides, the first contact blade being disposed to be adjacent the first longitudinal side of the pressing plate, the insertion hole being aligned with the second longitudinal side of the base plate and being disposed along the pressing plate to receive the second contact blade, the first and second contact blades being bent over the pressing plate for tightly holding the flat conductor between the base plate and the pressing plate.

13. The terminal fitting of claim 12, wherein the base plate and the pressing plate are substantially planar.

* * * * *